United States Patent [19]

Schalip

[11] Patent Number: 4,826,153

[45] Date of Patent: May 2, 1989

[54] PORTABLE FOLDING FREESTANDING GYM

[76] Inventor: John D. Schalip, 185 Savona Walk, Ste. 102, Long Beach, Calif. 90803

[21] Appl. No.: 30,952

[22] Filed: Mar. 2, 1987

[51] Int. Cl.[4] ..... A63B 21/06

[52] U.S. Cl. ..... 272/118; 272/117

[58] Field of Search ..... 272/62, 93, 117, 118, 272/134

[56] References Cited

U.S. PATENT DOCUMENTS

| | | | |
|---|---|---|---|
| 3,850,428 | 11/1974 | Zuber | 272/62 |
| 4,256,300 | 3/1981 | Boucher | 272/62 |
| 4,257,590 | 3/1981 | Sullivan et al. | 272/117 |
| 4,286,782 | 9/1981 | Fuhrhop | 272/117 |
| 4,431,181 | 2/1984 | Baswell | 272/62 |
| 4,441,706 | 4/1984 | Koraniewski | 272/118 |
| 4,632,388 | 12/1986 | Schleffendorf | 272/117 |
| 4,700,944 | 10/1987 | Sterba et al. | 272/118 |

*Primary Examiner*—Richard J. Apley
*Assistant Examiner*—J. Welsh
*Attorney, Agent, or Firm*—Emmett Pugh

[57] ABSTRACT

A portable, folding and freestanding exercise device-/apparatus comprised of a contoured main frame made up of a pair of pivoting vertical rectangular sections, each section comprised of a pair of vertical channel-shaped frame members inter-connected at their top and lower end by horizontal curved-shaped members. A pair of pivotally mounted horizontal curved-shaped leg extensions are provided for added stability. A horizontal overhead bar is provided for the various cable configurations needed for the numerous exercises, and is affixed with a pair of pivotally mounted flat J-shaped hooks and a pair of inline pulleys for the cable. The pair of pivoting J-shaped hooks allow the overhead bar to be attached to the main frame. A horizontal frame lock/-lower pulley slide bar is provided to lock the main frame and horizontal leg extensions in the open position and to accommodate the lower pulley slide. The lower pulley slide is provided for proper cable alignment with the overhead bar and the desired cable configuration and exercise. A vertical flat bar weight track mounted to the upper and lower pivot points of the pair of vertical rectangular sections is provided for the mounting of the weight tracking guide, which in conjunction with the use of the vertical weight stacking bar facilitates with keeping the barbell weights in a controlled vertical movement. Also, provided to move the desired weights thru the vertical movements of the exercises, is the weight pull bar, affixed with a portion of chain, to be connected to the desired cable configuration.

3 Claims, 4 Drawing Sheets

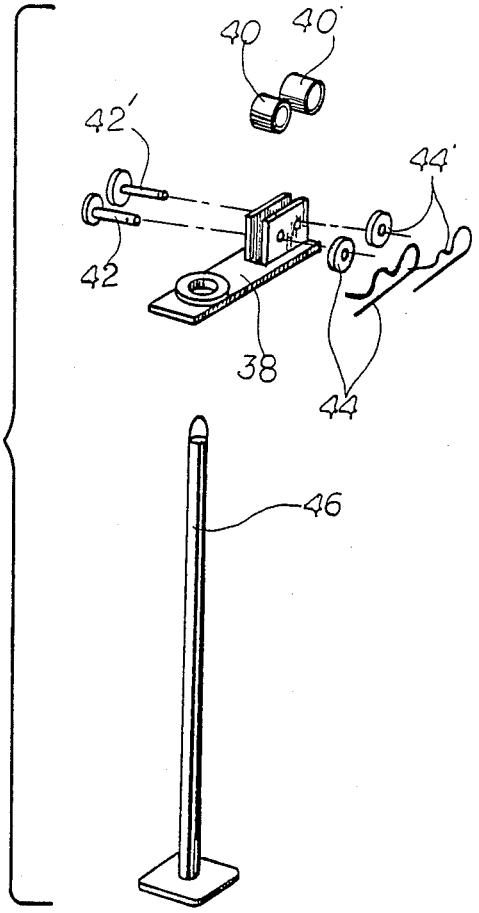
FIG. 5.
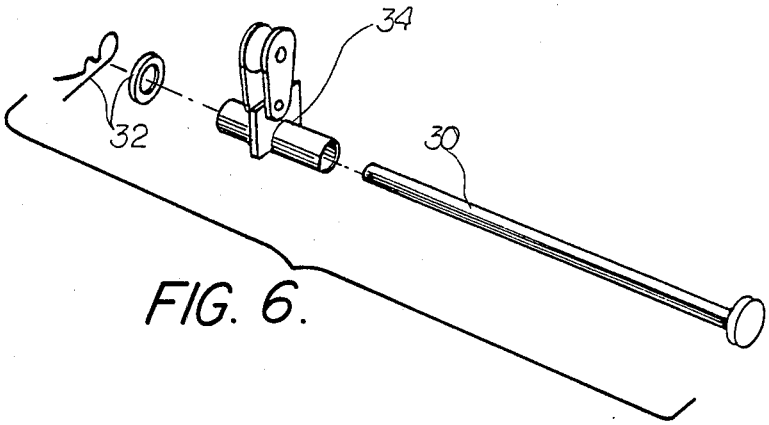
FIG. 6.
FIG. 7.
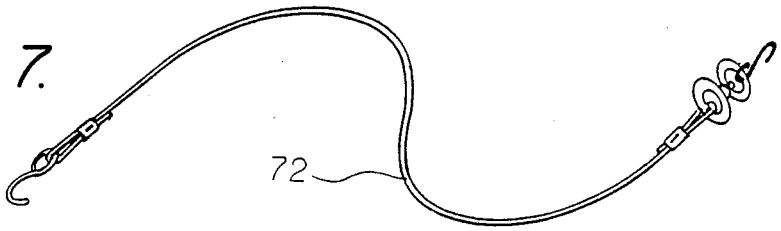

PORTABLE FOLDING FREESTANDING GYM

BACKGROUND OF THE INVENTION

Description of Prior Art

A variety of portable and collapsible freestanding exercise devices/apparatus have been developed for the serious weightlifting enthusiast but problems with some of these exercise devices are as such, complexity of construction; takes much time to assemble for set-up and to disassemble for storage or transportation; they take up large exercise areas; and they also lack in visual appeal.

While some of these exercise devices/apparatus claim to be portable and collapsible, the user still has to take much time in aligning frame members and placing bolts for assembly and to reverse this procedure for storage or transporting; although some are pivotal in design for fold-up and collapsing for storage and transporting, they are not readily accepted by those of whom they were designed for use in the home or office.

One solution to the problem as stated above is to make available a multi-functional exercise device/apparatus that meets all of the above requirements for the serious athlete or exercise enthusiast.

Previous attempts to meet the above stated requirements for a portable and collapsible freestanding exercise device/apparatus is disclosed in the following U.S. Patents; see next page.

U.S. Pat. No. 4,257,590 to Sullivan et al; another is taught by U.S. Pat. No. 4,286,782 of Fuhrhop. Although the devices/ apparatus meet the requirements of being portable and collapsible, they take much time to assemble and disassemble for use and to store or transport; and they also are complex in design and construction. Another exercise device/apparatus U.S. Pat. No. 4,441,706 to Korzaniewski, although not disclosed as a portable exercise device/ apparatus, if to be obvious to be made portable, the exercise device would have to be disassembled by unbolting the frame members thus taking much time, and still obvious not to be collapsible due to no disclosed pivot points of the framework. And still another exercise device/ apparatus attempts to be made collapsible in the U.S. Pat. No. 4,256,300 to Zuber, there is disclosed a gymnastic apparatus comprised of a main section and wing sections that are pivotally mounted for collapsibility. But as noted, this apparatus is a gymnastic exercise device and does not allow weightlifting exercises to be performed and also when set-up for use the device takes up a large exercise area. It is also complex in construction and would take several people to assemble and disassemble this apparatus.

There presently exists a need for a portable and collapsible freestanding multi-functional exercise device that is simple in design, strong in construction, easy to assemble for use and disassemble for storage and transporting and does not require a large exercise area.

There herein invention is designed to meet and overcome the problems as stated by meeting all of the above solutions for the most serious of weightlifting enthusiast.

SUMMARY OF THE INVENTION

It is accordingly an object of the present invention to provide a new and improved portable and collapsible free-standing gym device / apparatus capable of allowing performance of a wide variety of excercises.

Another object of the invention is to provide an contoured frame supporting structure capable of pivoting into a set-up position on a floor or the like, and therefore fold up into substantially a flat or narrow storage or transport position after the excercises are completed.

A further object of this invention in accordance with the preceeding objects is to provide a pair of pivoting lower horizontal leg extensions for providing greater structural rigidity and stability while in use and also to provide access holes for the placement of the lower horizontal frame lock / pulley slide bar.

Still another object of the invention is to provide in accordance with the preceding objects an manually quick-connecting horizontal overhead bar for supporting a pair of in-line pulleys needed for the various cable configurations for different weightlifting excercises.

A still further object of the invention is to provide a collapsible gym / excercise device which occupies a small amount of space, such as a corner, when in the set-up position.

The unique design of the portable, collapsible freestanding exercise device/ apparatus allows the pivoting main framework and the horizontal leg extensions to be manually opened and closed with ease by only one person. The minimal amount of components needed to further enchance this exercise device for use is also provided with only one person in mind to completely assemble and disassemble this device.

The above and still further objects, features and advantages will become apparent upon consideration of the following detailed description of the preferred embodiment thereof, especially when taken in conjunction with the accompanying drawings.

BRIEF DESCRIPTIONS OF THE DRAWINGS

FIG.5 is an exploded group perspective view of the vertical weight tracking guide with roller bushings and roller bushing retainer shafts with washers and clips, all the above work in conjunction with the also shown weight stacking bar.

FIG.6 is an exploded group perspective view of the horizontal frame lock/lower pulley slide bar with the lower pulley slide and retainer washer and clip.

FIG.7 is a perspective view of the weight pull cable with attached swivel and S-hooks.

DESCRIPTION OF THE PREFERRED EMBODIMENT

Figure 1:
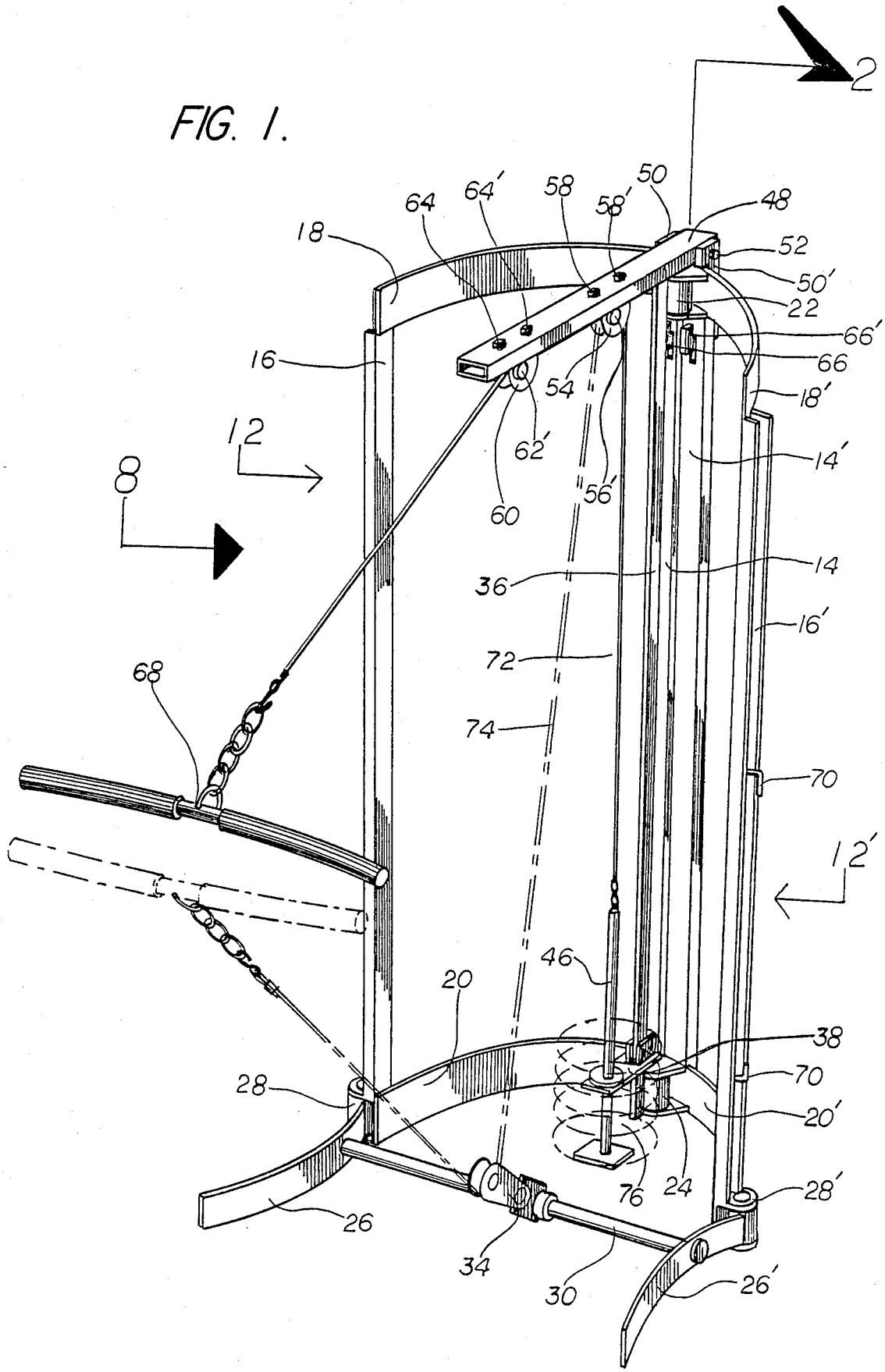
FIG.1 is a perspective view of the exercising machine of the present invention in the complete set-up position and also with an optional mode of use is being illustrated.
Figure 3:
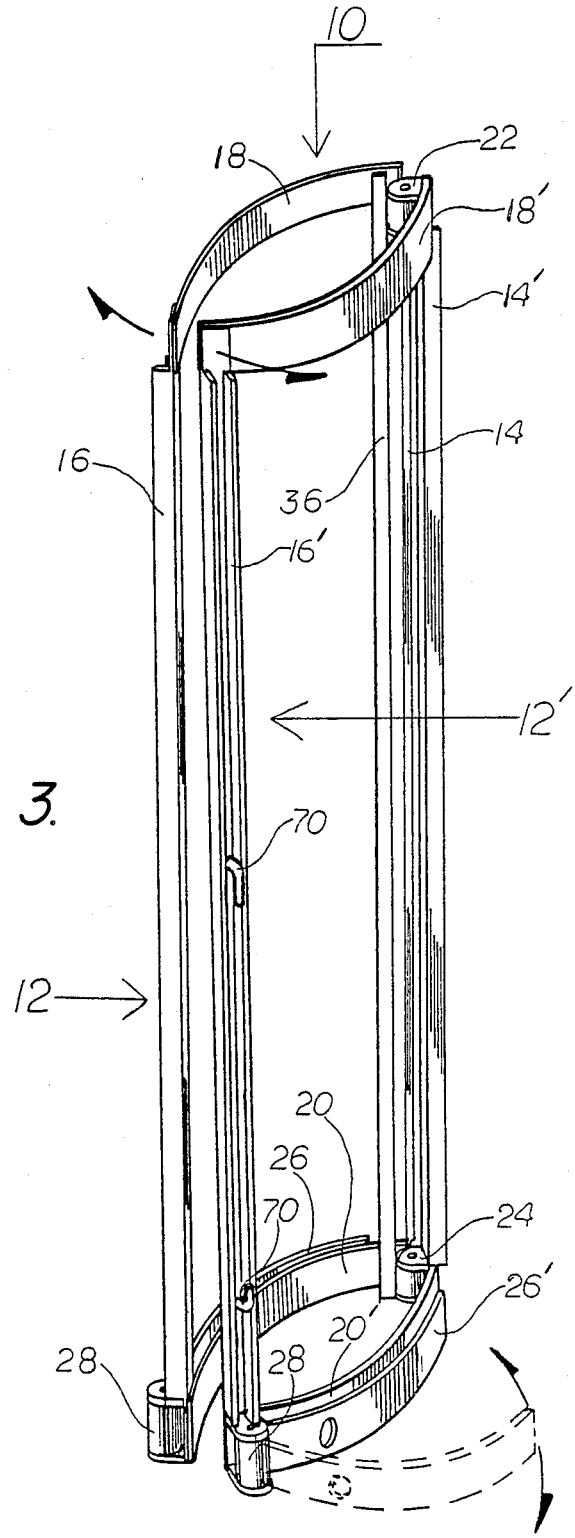
FIG.3 is a perspective view of the exercising machine pivoting mainframe and lower horizontal contoured base leg extensions in the folded storage or transport position.

The exercise machine of the present invention is generally designated by the reference numeral 8 and includes a main framework 10, which is vertically oriented and includes a pair of rectangular contoured sections 12, 12', each comprised of a pair of vertical steel channel-shaped frame members of the like 14,14', 16,16' interconnected rigidly by welding, rivets or the like at their top most portion by a horizontal contoured flatplate member 18,18' and their lower base end by matching horizontal contoured flatplate members 20, 20'; both vertical rectangular sections 12, 12' making up the main framework 10 are pivotally connected where at the inner most top of the rear vertical channel members 14, 14' and the inner most end portion of the upper horizontal contoured flatplate members 18,18' or the like interconnect and where the lower end of the same vertical channel members 14,14' interconnect with the inner most end portion of the lower horizontal contoured base members 20,20' by an upper mainframe hinge 22 and an inner lower mainframe hinge 24, so the user can fold the main framework 10 into a narrow unit as illustrated in FIG.3 for storage or transport or to unfold the main framework 10 and and assemble the following described components to complete the exercise machine 8 for use as illustrated in FIG. 1.

Pivotally mounted to where the left front and right front vertical channel members 16, 16' interconnect with the front portion of the left lower contoured base member 20 and the front portion of the right lower contoured base member 20', respectively, are two contoured base leg extensions 26, 26' connected by a pair of base leg extension hinges 28,28' welded to the lower base members 20,20', which are fully extended to their forward position and locked together by putting the frame lock/lower pulley slide bar 30 thru the holes provided in the base leg extensions 26, 26'. The frame lock/lower pulley slide bar 30 is first inserted fully thru either base leg extension 26 or 26', the lower pulley slide 34 is then slid over the frame lock/lower pulley slide bar 30 and then inserted thru the other remaining base leg extension 26 or 26', so the frame lock/ lower pulley slide bar 30 is then locked in the set-up position by placing the frame lock lower pulley slide bar retainer washer and clip 32,FIG.6 over the end of the frame lock/lower pulley slide bar 30. The pivoting base leg extensions 26,26' upon the removal of the frame lock/ lower pulley slide bar 30 are then manually folded back until they touch and conform with the matching lower base members 20, 20' for storage or transport as illustrated in FIG.3

Figure 2:
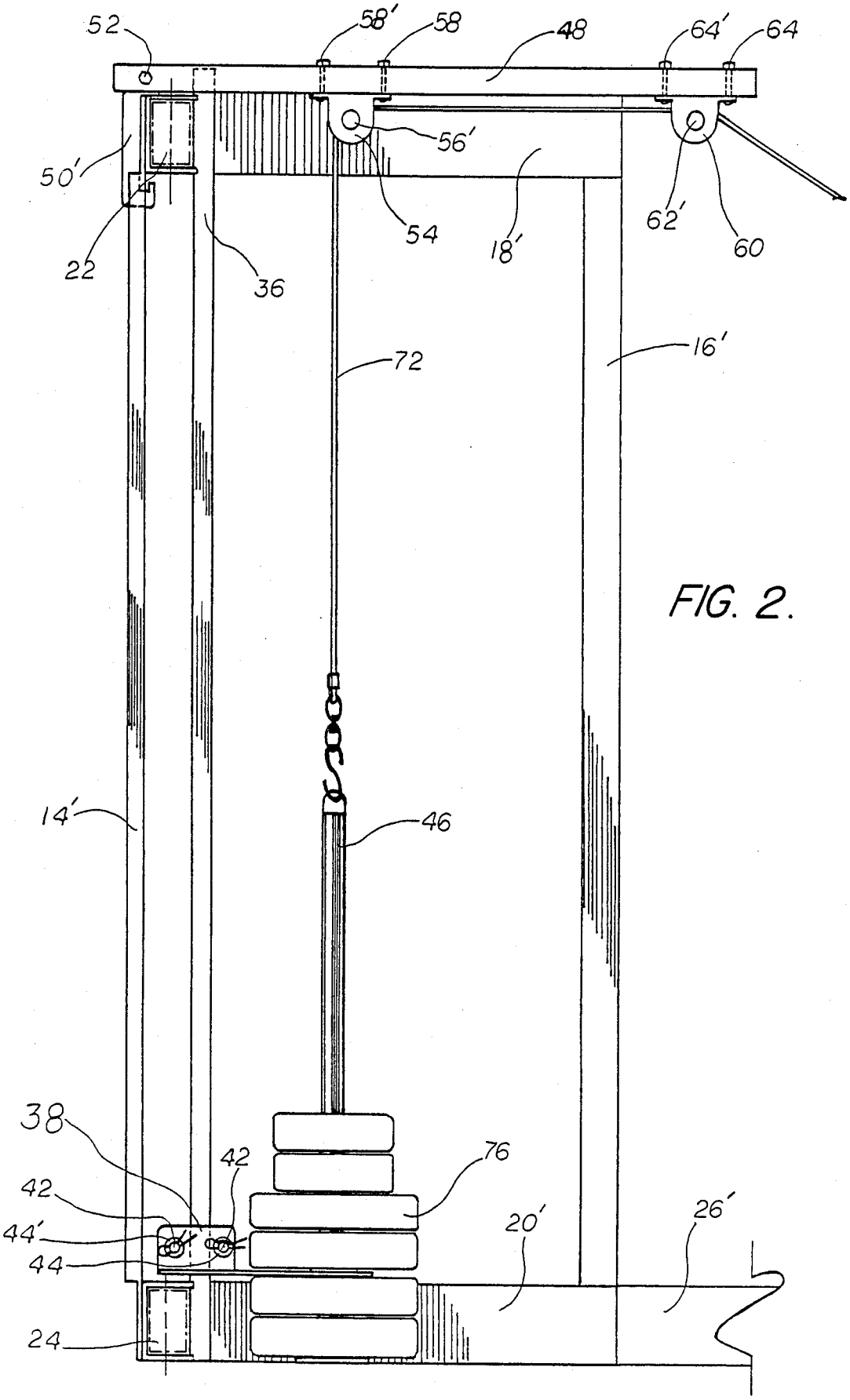
FIG.2 is a vertical sectional view of the machine taken generally upon the plane passing along section line 2—2 of FIG.1 but illustrating the proper mounting position of the horizontal overhead bar and proper positioning and hook-up of the vertical weight tracking guide to the vertical weight track of which both work with association to the weight stacking bar and weights.
Figure 9:
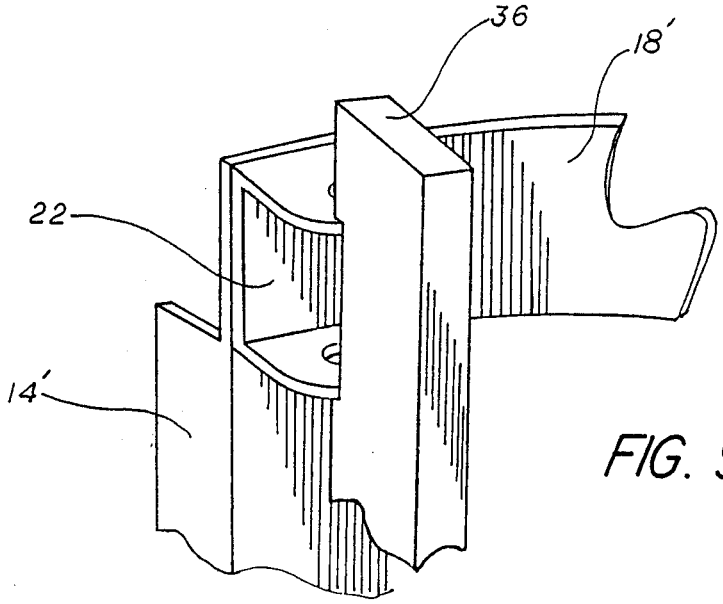
FIG.9 is a fragmental view illustrating the position of the vertical weight track to a portion of the upper hinge of the mainframe and also the 1" inch extension of the weight track for the positioning and centering of the overhead bar when mounted.

Welded rigidly to and extending approximately 1 inch above the inside upper mainframe hinge 22, FIG. 9 and extending down to the inside lower main hinge 24 flush with the bottom portion of the lower horizontal base members 20, 20' as illustrated in FIGS.1,2, and 3 is the vertical weight track bar 36, made of rectangular steel flatbar, and acting as a guidance track for the weights 76. To keep the weights in a vertical line and void of swaying as they move up and down on the weight track bar 36, the weight tracking guide 38, is mounted to the weight track bar 36 with it's vertical slotted end FIG.5 over the weight track bar 36 and inserting the two weight tracking guide roller bushings 40,40' and weight tracking guide roller bushing shafts 42,42' thru the holes in the vertical uprights of the weight tracking guide 38, FIG.5 having then the weight track bar 36 between the two roller bushings and shafts 40,40',42,42' and secured in placed by placing the retainer washer and clips 44,44' over the end of the roller bushing shafts 42,42' FIG.2 illustrates the mounting. Once the mounting of the vertical weight tracking guide 38 is completed, placement of the vertical weight stacking bar 46 made of steel round stock or the like is then inserted thru the hole provided in the end opposite the vertical uprights of the weight tracking guide 38 FIG,5. Standard barbell weights 76 can then be put over the weight stacking bar 46 as desired.

Figure 4:
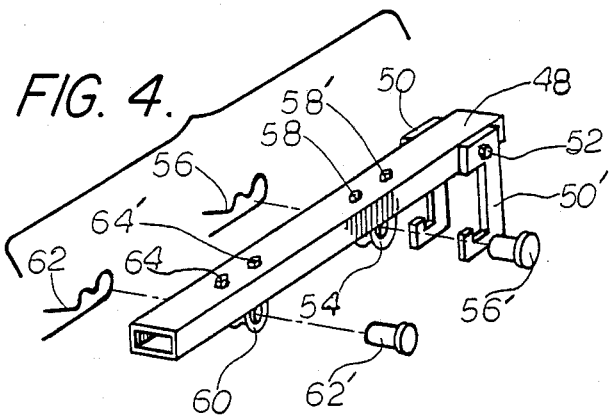
FIG.4 is a perspective view of the horizontal overhead bar with pivotal mounting J-hooks and retainer pins and clips for the removable shives of the shown mounted front and rear pulleys.
Figure 8:
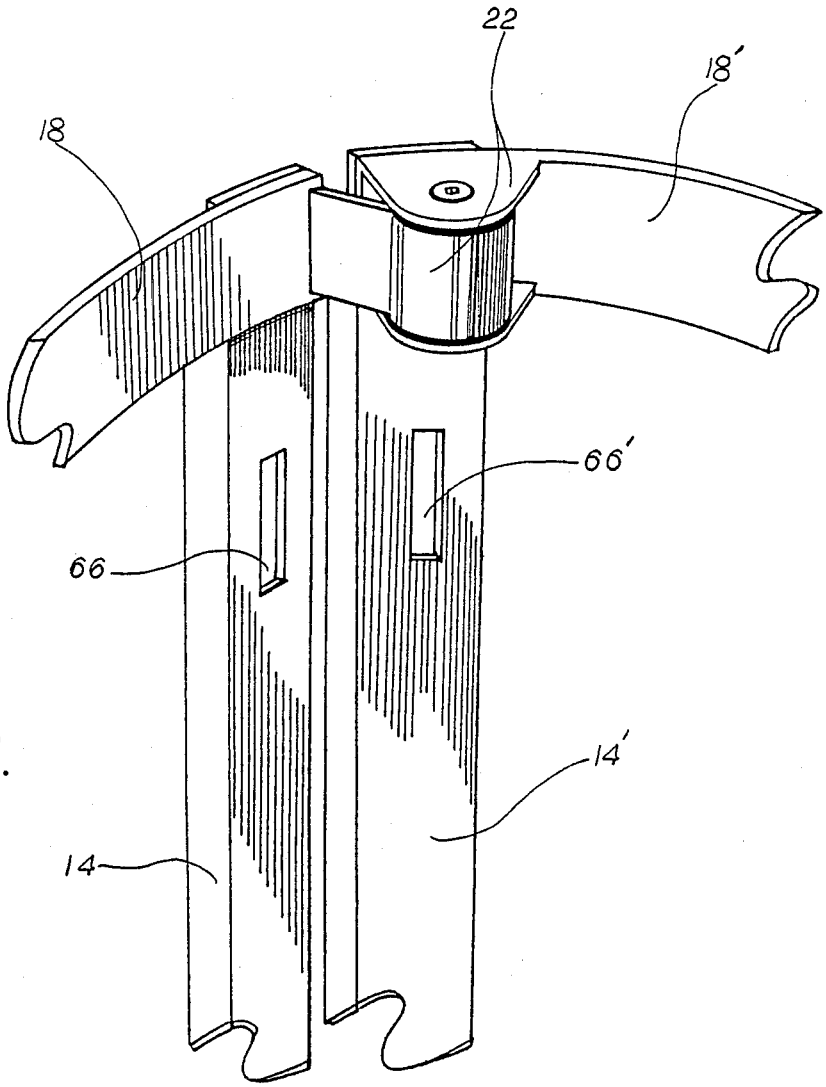
FIG.8 is a fragmental view illustrating the upper hinge of the mainframe and the horizontal overhead bar J-hooks retainer slots in the rear vertical channel members.

The horizontal overhead bar 48 FIG.1,2 and 4 made of tubular steel is affixed with a rear pulley 54 of which has a removable shive and shive shaft 56' and shive shaft clip 56 for the changing of cable 72 for various exercises, the rear pulley 54 is mounted to the overhead bar 48 by two bolts 58, 58' FIG.2; also mounted near the front end of the overhead bar 48 is another inline pulley 60, of which is also supplied with an removable shive and shive shaft 62' and shive shaft retainer clip 62, the front pulley is mounted to the overhead bar 48 by two bolts 64,64'. Located at the opposite end of the overhead bar 48 from the front pulley 60, two individual pivoting J-hooks 50, 50' are mounted to the overhead bar 48 by a pivot bolt 52, to allow the user to manually install the overhead bar 48 by inserting the two individual pivoting J-hooks 50, 50' into the two J-hooks retainer slots 66,66' FIG. 8 located in the rear vertical channel members 14, 14'. Approximately midway between the rear pivoting J-hooks 50,50' and the rear overhead bar pulley 54 on the underside of the overhead bar 48, a rectangular slot for the insertion of the 1 inch extension of the vertical weight track bar 36, FIG.9 is provided for the proper alignment of the overhead bar 48 while being installed.

To provide vertical movement to the weights 76 after the user has completed the set-up of the exercise machine 8, FIG.1 and mounted the overhead bar 48, he/-she may now remove the shive from the rear pulley 54 and insert the cable 72 with the swivel and S-hook and then re-install the shive and shive shaft 56' and shaft retainer clip 56 there by retaining the cable 72 to the pulley 54 securely for use. Next the shive is removed from the front overhead bar pulley 60 and the cable 72 is again locked in the pulley 60 by replacing the shive and shive shaft 62' and shive shaft retainer clip 62. Once cable 72 has been threaded thru the pulleys 54 and 60, the swivel and S-hook end of the cable 72 is hooked to the loop provided on the top of the weight stacking bar 46,FIG.2. The remaining end of the cable 72 with the single S-hook is then hooked into the desired chain link of the weight pull bar 68, therefore by pulling down on the weight pull bar 68 in a vertical movement will then move the weights 76 on the weight stacking bar 46 up and down on the vertical weight track 36.

Another exercise such as curls are performed on the exercise machine 8,FIG.1 by disconnecting cable 72 from the front overhead bar pulley 60 and the S-hook from the weight pull bar 68 chain, the cable 72 with the single S-hook is then brought down to the lower pulley slide 34 which is slid over the frame lock/ lower pulley slide bar 30, FIG.1, the cable 72 with the single S-hook end is then threaded thru the pulley of the lower pulley slide 34 and the single S-hook is re-attached to the desired chain link of the weight pull bar 68, thus alternating the cable configuration or route as shown in 74,FIG.1. The useer may now stand or sit and grasp the weight pull bar 68 in both hands and pull towards him / her thus moving the weights 76 up and down vertically along the vertical weight track 36, FIG.1.

The dimensional characteristics of the exercising machine while in the set-up position are as follows; the height of the framework is in the order of 6 feet while the overall width of the framework is 3 feet to 3½ feet and the overall depth of the machine is 3 feet to 3½ feet. As the above dimensions are for the exercise machine while in the set-up position this is an collapsible device for the ease of storage and transporting, therefore, this device when folded up the overall height remains the same 6 feet but the overall width is reduced to only 8 inches and with the horizontal pivoting base leg extensions folded back into the storage and transport position the overall depth is reduced to 20 inches.

The various components are of standard structural shapes and of steel but could be reproduced from aluminum, fibre-glass or the like, therefore rendering the device relatively inexpensive to manufacture and also safe in operation and long lasting.

The foregoing is considered as illustrative only of the principle of the invention. Further, since modifications and changes will occur, it is not desired to limit the invention to the exact construction and operation shown and described herein.

What is claimed as new is as follows:

1. A portable, collapsible freestanding exercise device/ apparatus comprising, a pair of vertical rectangular contoured sections, each section comprised of a front and rear vertical channel-shaped frame members interconnected at their top and lower end by horizontal curved-shaped members, said vertical rectangular sections are pivotally connected with hinges at said top and lower ends, for movement between a stored fold-up and a fixed set-up position and attached rigidly between said top and lower hinges is a vertical weight track adapted to engage a weight track guide which includes weights in order; and to keep the weights while in their vertical movement void of side sway movement.

2. The structure as defined in claim 1 together with a pair of pivotally mounted horizontal contoured base leg extensions mounted to the front of said pair of lower end horizontal contoured base members for increased stability and a removeable lower horizontal frame lock/lower pulley slide bar connected between said base leg extensions when in the set-up position.

3. The structure as defined in claim 2 together with a removeable horizontal overhead bar with a pair of pivoting flat J-hooks of which is mounted by inserting the J-hooks into said rear vertical channel members, said bar supports a pair of pulleys of which a cable is entrained for moving the weights.

* * * * *